US007885576B2

(12) United States Patent
Spence et al.

(10) Patent No.: US 7,885,576 B2
(45) Date of Patent: Feb. 8, 2011

(54) BELT INSTALLATION TOOL

(75) Inventors: James J Spence, Honeoye Falls, NY (US); Norman D Robinson, Jr., Rochester, NY (US); Stephen F Skrainar, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 487 days.

(21) Appl. No.: 11/923,740

(22) Filed: Oct. 25, 2007

(65) Prior Publication Data

US 2009/0110435 A1 Apr. 30, 2009

(51) Int. Cl.
*G03G 15/08* (2006.01)

(52) U.S. Cl. ..... 399/121; 399/297; 399/411; 198/844.2

(58) Field of Classification Search ..... 399/121, 399/297, 411; 198/844.2
See application file for complete search history.

(56) References Cited

U.S. PATENT DOCUMENTS 5,400,121 A * 3/1995 Foote ..... 399/116
2003/0152400 A1* 8/2003 Maier et al. ..... 399/121

FOREIGN PATENT DOCUMENTS

JP 2001337577 A * 12/2001

OTHER PUBLICATIONS

English abstract, JP 2001337577 A to Ikeda et al.*
U.S. Appl. No. 11/895,864, filed Aug. 28, 2007 by Bruce J. Parks.
U.S. Appl. No. 11/895,863, filed Aug. 28, 2007 by Bruce J. Parks.

* cited by examiner

*Primary Examiner*—Ryan D Walsh

(57) ABSTRACT

A tool for installation of intermediate belts by a customer includes a lightweight frame structure that is collapsible for handling and ease of belt loading onto the tool itself. The frame structure includes linkage such that when a handle connected to the frame structure is rotated; the framework will expand into the hanging belt and force the belt to take the shape of an intermediate belt transfer module profile. The intermediate transfer belt is then slid onto rollers of the intermediate belt transfer module.

19 Claims, 7 Drawing Sheets

BELT INSTALLATION TOOL

This invention is related to electrostatographic printing machines, and more particularly, to an electrostatographic machine wherein toner images are deposited on an intermediate belt and transferred to various substrate media and a belt installation tool for positioning the intermediate belt within the printing machine.

Electrostatographic printers are known in which a single color toner image is electrostatically formed on a charge retentive member, such as, a photoreceptor drum or belt. The toner image is directly transferred to a receiving substrate, typically paper or other suitable print receiving material. The toner image is subsequently fused or affixed to the substrate, usually by simultaneous application of heat and pressure.

In other electrostatographic color printers, a plurality of toner imaging systems each including a charge retentive member are used to create multiple color toner images on a single image receiving member. The color toner images are electrostatically transferred from the charge retentive members to an intermediate transfer member to form a composite toner image on the intermediate transfer member. The composite toner image is electrostatically transferred to the final substrate.

In these electrostatic marking systems, a photoreceptor belt or drum surface is generally arranged to move in an endless path through the various processing stations of the xerographic process. In this endless path, several xerographic-related stations traversed by the photoconductive belt or drum, becomes worn and in several of these stations various belt configurations in addition to photosensitive belts are uses, such as, transfer belts, pre-fuser transport belts, intermediate belts and the like. Each of these belts is exposed to friction and moved by rollers that provide the belt movement to accomplish the belt purpose. After a while, the belts need to be replaced. Since the photoreceptor surface is reusable when the toner image is transferred to a final support material, such as paper, the surface of the photoreceptor is constantly braided and cleaned by a blade and/or brushes and prepared to be used once again in the marking process.

Image-carrying belts used in color printing processes can be especially difficult to replace and install. In some machines, the horizontal intermediate transfer belt is about 1400 mm wide (beyond the average person's arm span) and 3000 mm long. Belt installation requires careful alignment with the belt module to prevent belt damage. At even longer belt lengths, the replacement operation is extremely difficult to install a belt without belt damage occurring. This difficulty is especially exacerbated if only one person is available to perform the task.

Even in monochrome marking systems that use shorter belts for various functions, extreme care must be taken not to damage the belts during installation. In some instances, the belts are constructed of thin flexible polymeric materials that can easily scratch or be damaged during belt replacement or even during original installation.

Belt installation improvements aimed at solving this problem include U.S. patent application Ser. Nos. 11/895,864 and 11/895,863, both filed Aug. 28, 2007 by Bruce J. Parks, where hinged guides are disclosed that protrude from the front of the machine from the housing at two or more roller positions providing a pre-staging area for the belt in U.S. patent application Ser. No. 11/895,864. The belt would then be draped in a position close to the actual belt housing but without the clearance issues. The belt would then be manually tensioned as it is slid over the belt module. After installation, the guides would be removed or pivoted back into their inactive positions. In U.S. patent application Ser. No. 11/895,863 belt guides are disclosed that fit into housings in hollow rollers or housings adjacent rollers of belt modules of products that have long transfer belts. These disclosures are included herein by reference to the extent necessary to practice the present disclosure.

Even with the belt installations improvements mentioned heretofore, there is still a need for a quick and easy way to install extremely long and wide belts onto marking modules of printing machines.

Accordingly, disclosed herein is a device to aid in installation of long and wide intermediate belts used in intermediate belt transfer (IBT) marking modules. The device includes a tool that comprises a lightweight folding frame, with rollers at belt tangent points, that manually expands into the shape of the intermediate belt transfer module profile. The frame can be temporarily attached to the module and hold the belt in a shape and orientation that allows it to be easily slid from the frame onto the module.

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

For a general understanding of the features of the disclosure, reference is made to the drawings. In the drawings, like reference numerals have been used throughout to identify identical elements.

Figure 1:
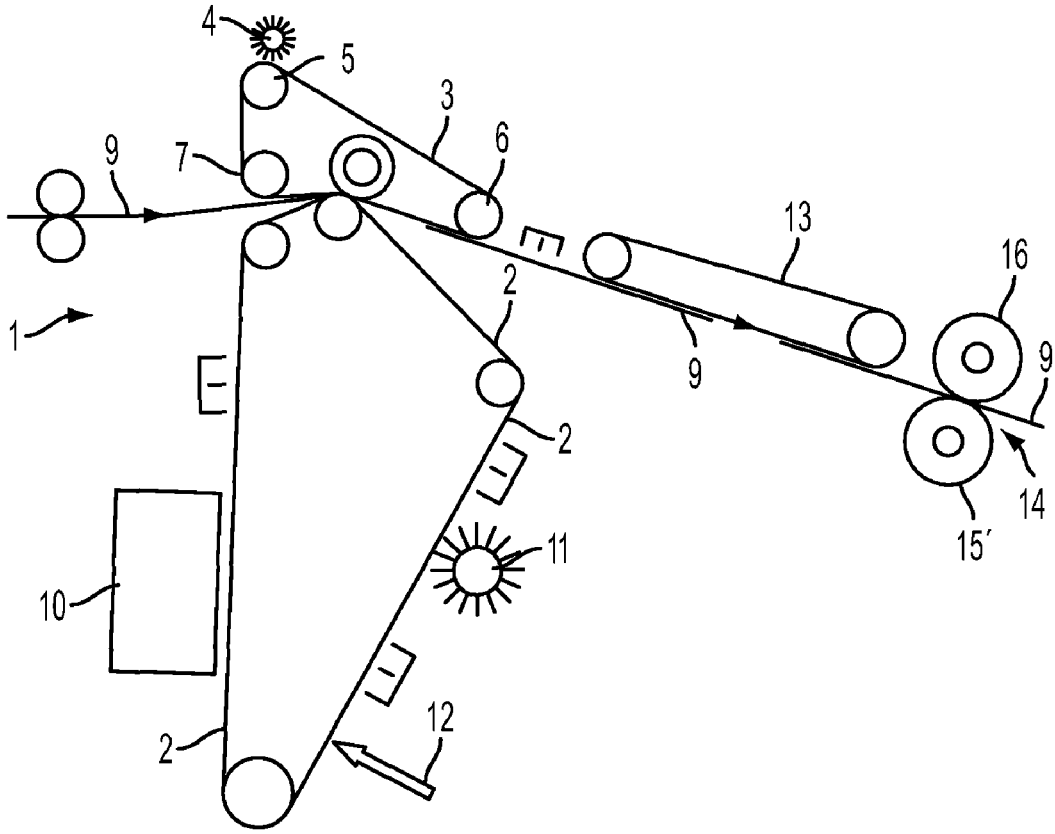
FIG. 1 is a frontal view of a typical monochrome marking system using belts for various purposes.

In FIG. 1, a complete electrostatic marking system 1 using different belts and rollers is illustrated having a photoconductive belt 2, a transfer belt 3, a transfer belt cleaning brush 4, transfer belt rollers 5, 6 and 7 upon which the transfer belt 3 travels. The transfer belt cleaner brush 4 is positioned over conductive grounded roller 5 where transfer belt 3 passes. A paper or paper path 9 is designated where the paper is transported between transfer belt 3 and photoconductor belt 2. A developer housing 10, a photoconductor cleaning brush 11 and exposure station 12 are shown. A pre-fuser transport belt 13 is depicted as it provides means for transport of the paper 9 to the fuser station 14. Fuser station 14 is made up of a fuser roll 15 and a pressure roll 16. Each of belts 2, 3 and 13 can be replaced using a variation of the belt installation tool of this disclosure.

Figure 2:
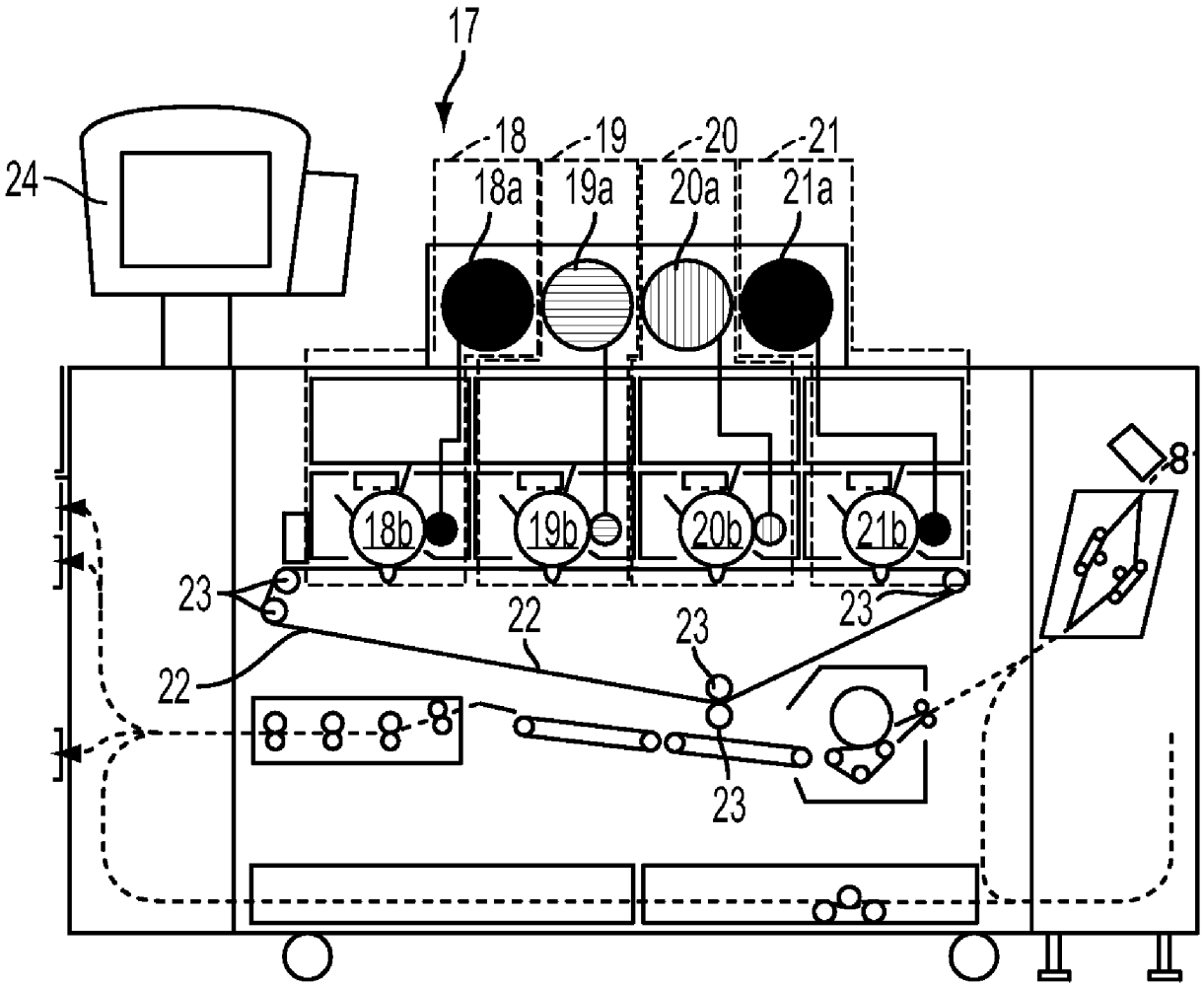
FIG. 2 is a frontal view illustrating a color system using an image transfer belt between color stations.

In FIG. 2, a front view of a color marking system 17 is illustrated having four color marking stations, a black marking station 18, a cyan marking station 19, a magenta marking station 20 and a yellow marking station 21 with each marking station comprised of toner bottles 18*a*, 19*a*, 20*a* and 21*a* along with developer housings 18*b*, 19*b*, 20*b* and 21*b*, respectively. It should be understood that additional marking stations could be employed, if desired. Traveling through each of these marking stations is an intermediate transfer belt 22 that travels around belt rollers 23. This FIG. 2 illustrates the type of belt-roller color system that can use the belt installation device of FIG. 3.

In FIG. 2, a color marking system is illustrated having a control panel 24 and marking or coloring stations. Traveling through these marking stations is an intermediate transfer belt 22 having rollers 23 around which belt 22 travels. At least one of these rollers 23 is powered to move belt 22. The other components of color system 17 are unimportant as they relate to the present invention. Belt 22 can be wide and lengthy and difficult to replace, however the use of the belt installation tool of this disclosure provides an easy, convenient and safe way to replace this belt 22.

Figure 3:
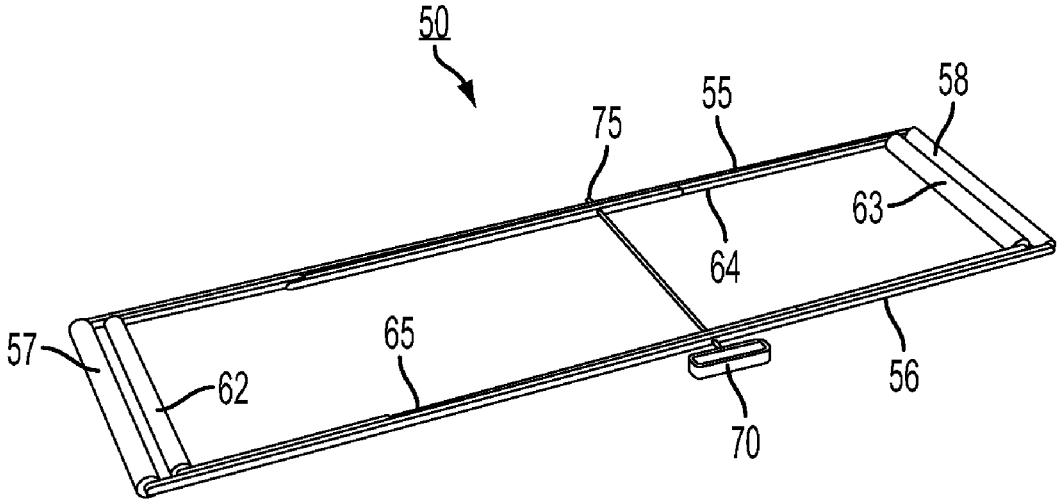
FIG. 3 is an illustration of the belt installation tool of the present disclosure in a collapsed form.
Figure 4:
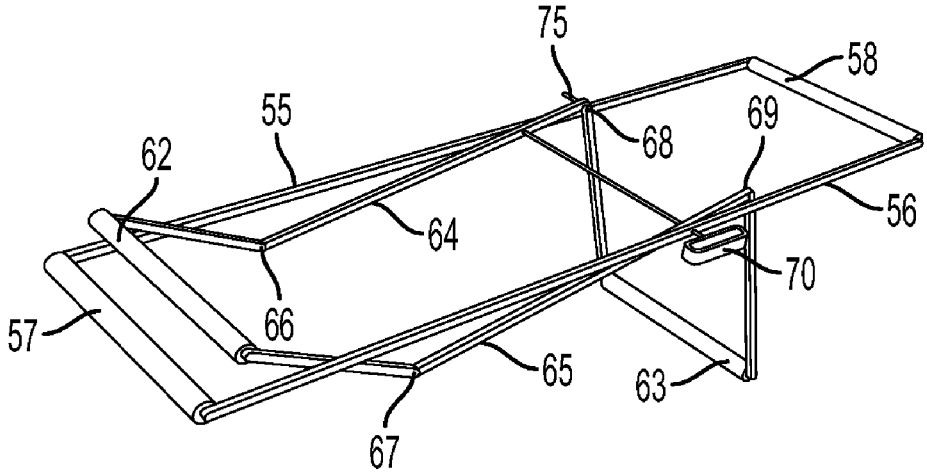
FIG. 4 is an illustration of the belt installation tool of FIG. 3 in its expanded form.

As shown in FIGS. 3 and 4, collapsed IBT installation tool 50 includes a lightweight folding frame that comprises a rigid rectangular shaped frame member having elongated opposite parallel sides 55 and 56 and end enclosure short side rollers 57 and 58. The lightweight material, which could be plastic, foldable wire or other suitable lightweight material, is used to minimize weight for customer handling since changing of the intermediate transfer belt is a part of customer maintenance. Pivotally connected to the rectangular shaped frame member is a foldable rectangular shaped frame member that includes end rollers 62 and 63 and side members 64 and 65. Side members 64 and 65 are hinged by conventional linkage at 66, 67, 68 and 69 and adapted to be articulated by rotation of handle 70 to expand in umbrella fashion into the form shown in FIG. 4.

Figure 5A:
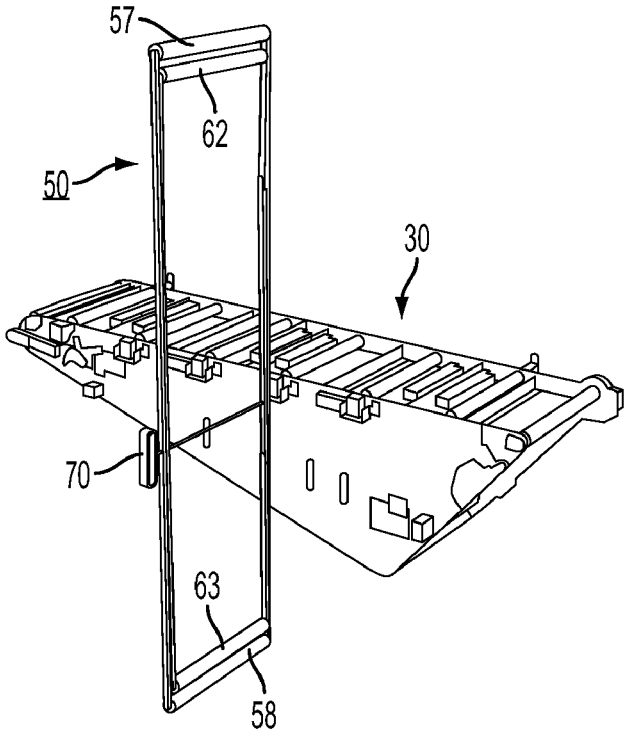
FIGS. 5A-5G show the belt installation tool of FIG. 3 in perspective views illustrating the belt installation steps.
Figure 5B:
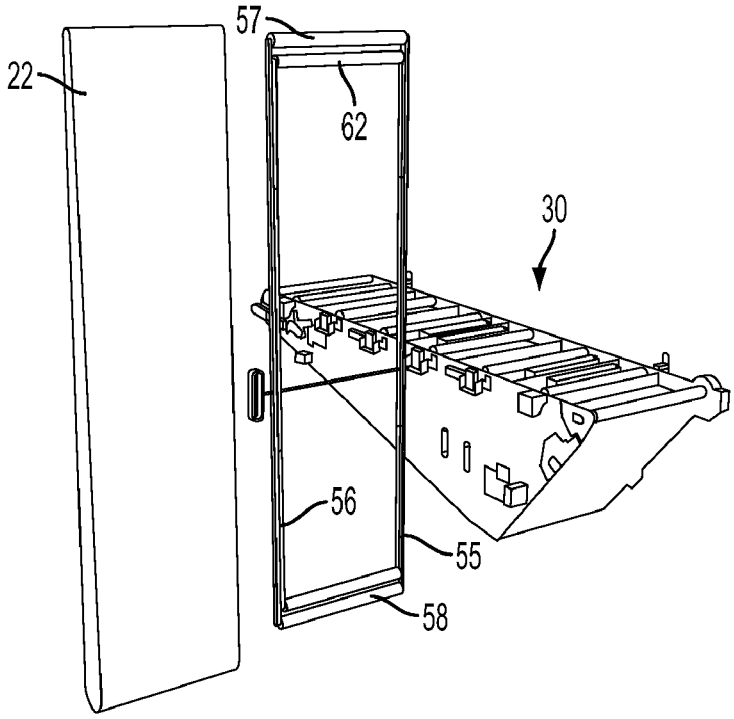
Figure 5C:
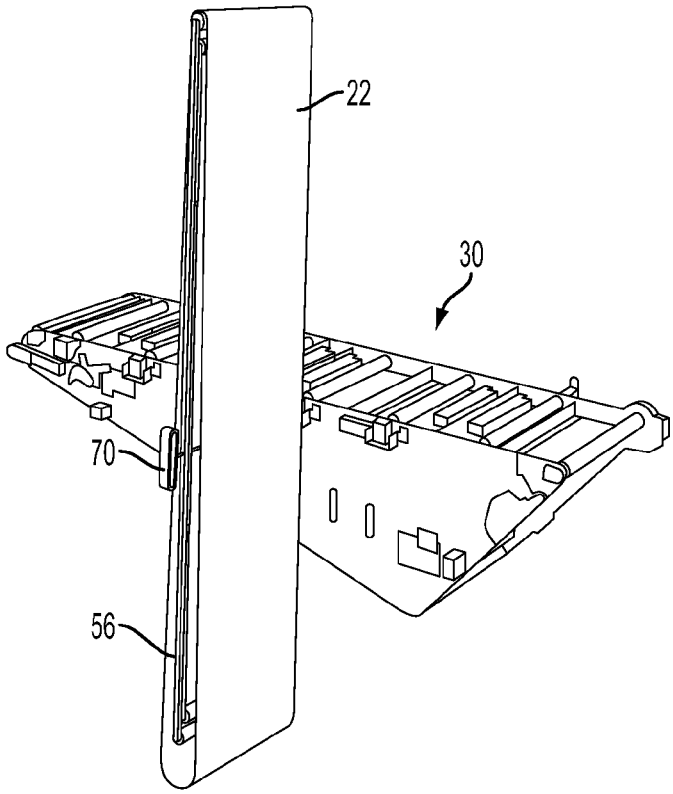
Figure 5D:
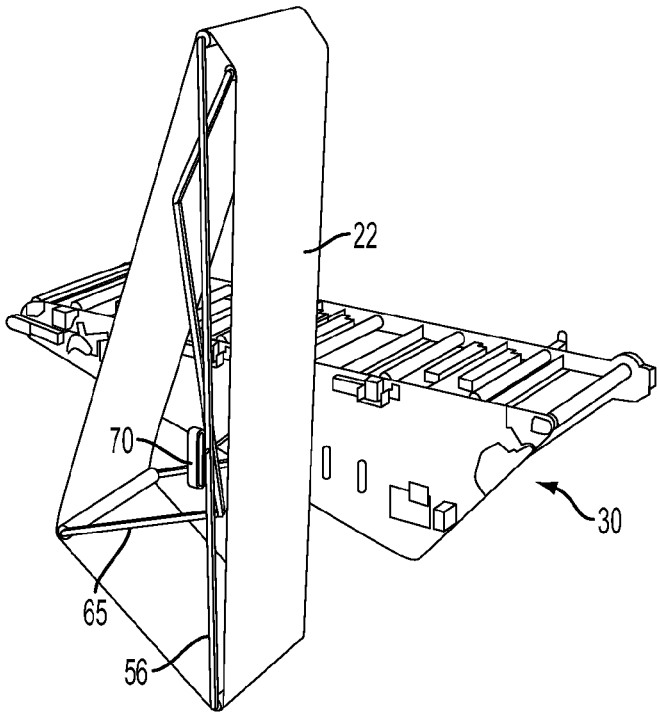
Figure 5E:
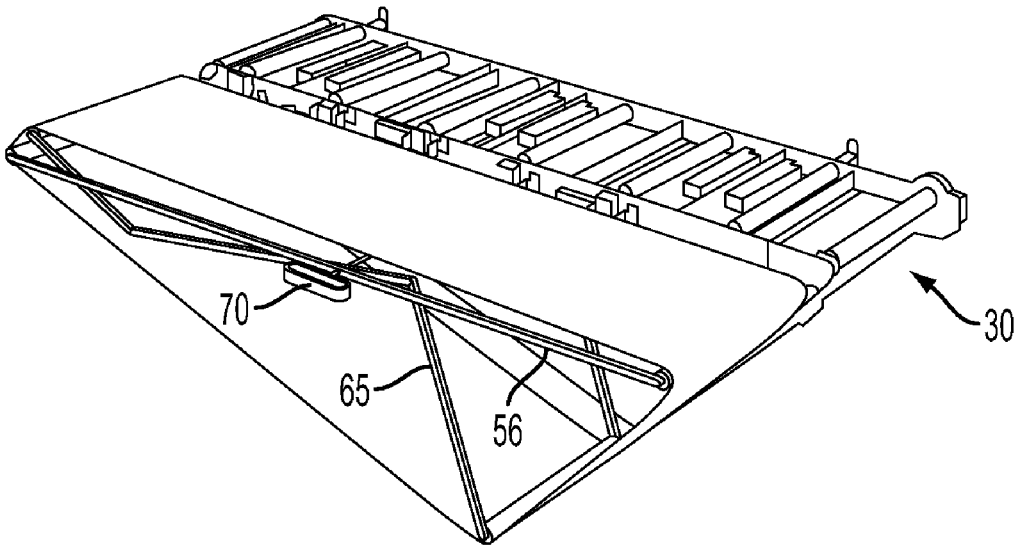
Figure 5F:
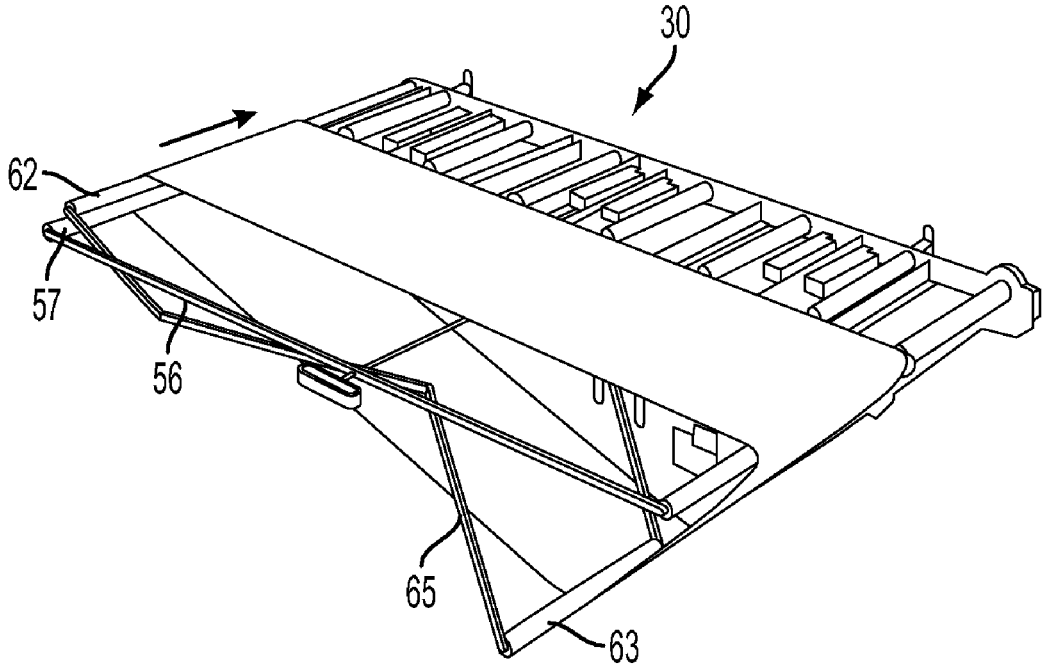
Figure 5G:
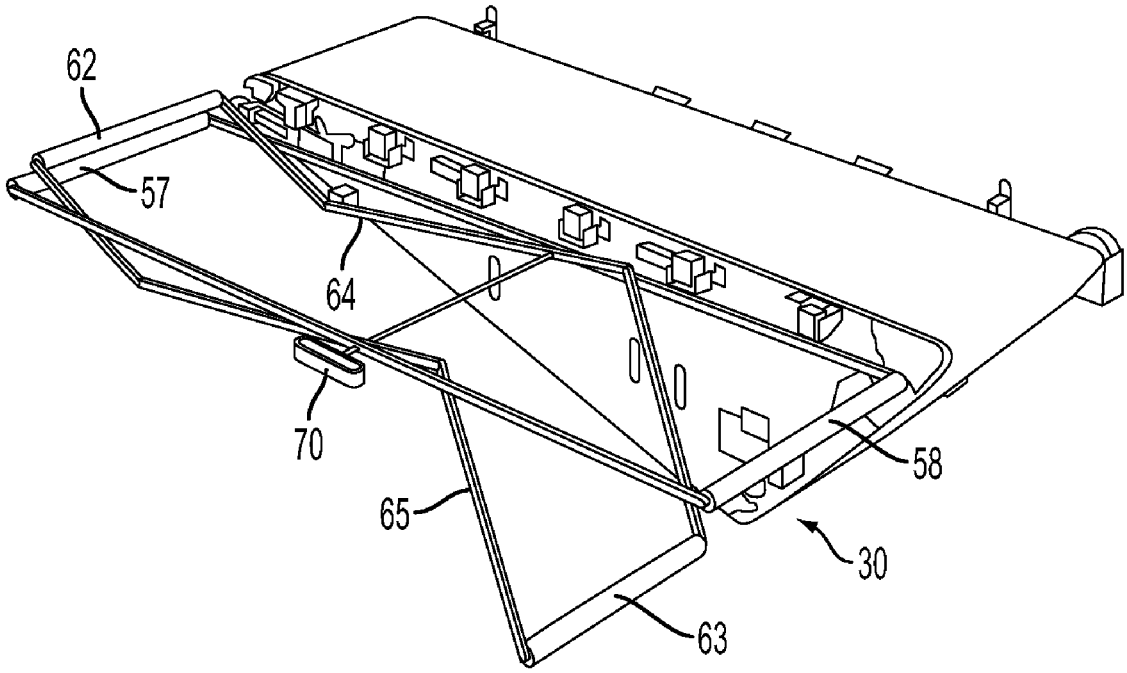

In practice, an intermediate transfer belt is replaced by first attaching the lightweight folding frame, in a conventional manner, by member 75 to the IBT module 30 while standing the frame in a vertical position as shown in FIG. 5A. As shown in FIGS. 5B and 5C, the IBT belt 22 is positioned relative to the frame and slipped over rollers 57 and 58. Afterwards, the tool is expanded in FIG. 5D by rotating handle 70. The tool is rotated 90° by handle 70 in FIG. 5E to orient intermediate transfer belt 22 to the coincide with the profile of IBT module 30. As shown in FIG. 5F, the intermediate transfer belt 22 is then slid from the installation tool 50 onto the IBT module. Once intermediate belt 22 is installed the customer follows the IBT module tension procedure and proceeds to remove the installation tool from IBT module 30 as shown in FIG. 5G. Handle 70 is then rotated counter clockwise to collapse the frame member and the frame member is then stored within IBT module 30.

It should now be understood that a belt installation tool is disclosed that aids in the installation of long and wide intermediate belts used in IBT marking modules. The tool consists of a lightweight folding frame, with rollers at belt tangent points, that is expanded by rotation of a handle into the shape of the IBT marking module. The frame is temporarily attached to the IBT marking module and holds the intermediate belt in a shape and orientation that allows it to be easily slid from the frame onto the marking module. Afterwards, the frame can be stored within the marking module. The installation tool can be adapted to install belts of any configuration including, but not limited to, photosensitive belts, transfer belts, pre-fuser transport belts, or intermediate belts and the like.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A device for aiding in installation of a long and wide intermediate belt onto a predetermined profile of an intermediate belt transfer marking module positioned within a xerographic apparatus, said device comprising:

a lightweight collapsible frame, said lightweight collapsible frame including rollers at belt tangent points that manually expand into the shape of the intermediate belt transfer marking module profile, said lightweight collapsible frame being temporarily attachable to said intermediate belt transfer marking module to hold said intermediate belt in said predetermined profile such that it allows said intermediate belt to be easily slid from said lightweight folding frame onto said intermediate belt transfer marking module.

2. The device of claim 1, wherein said collapsible frame includes two rectangular members.

3. The device of claim 2, wherein one of said rectangular members is adapted to be pivoted relative to each other.

4. The device of claim 2, wherein one of said two rectangular members is rigid and the other of said two rectangular members is adapted to be articulated.

5. The device of claim 4, wherein said two rectangular members include side members and end members connected to said side members, and wherein said end members comprise rollers.

6. The device of claim 5, wherein said collapsible frame is adapted for non-permanent connection to said intermediate belt transfer module.

7. The device of claim 6, wherein one of said two rectangular members of said collapsible frame fits inside the other of said two rectangular members when said collapsible frame is in a collapsed configuration.

8. The device of claim 7, wherein said collapsible frame is storable inside said intermediate belt transfer module when in said collapsed configuration.

9. A belt installation tool for use in installing or removing a belt(s) from a belt module assembly having a predetermined profile, comprising:

a collapsible frame; and a handle operatively connected to said collapsible frame such that rotation of said handle expands said collapsible frame from a collapsed position into said predetermined profile of a belt module assembly.

10. The belt installation tool of claim 9, wherein said collapsible frame includes two rectangular members.

11. The belt installation tool of claim 10, wherein one of said two rectangular members is adapted to be pivoted relative to the other.

12. The belt installation tool of claim 10, wherein the other of said two rectangular members is rigid and said one of said two rectangular members is adapted to be articulated.

13. The belt installation tool of claim 12, wherein said rectangular members include side members and end members connected to said side members, and wherein said end members comprise rollers.

14. The belt installation tool of claim 13, wherein said collapsible frame is adapted for non-permanent connection to said belt module assembly.

15. The belt installation tool of claim 14, wherein one of said two rectangular members of said collapsible frame fits inside the other of said two rectangular members when said collapsible frame is in a collapsed configuration.

16. The belt installation tool of claim 15, wherein said collapsible frame is storable inside said belt module assembly when in said collapsed configuration.

17. A method for installing a belt in a printing apparatus, comprising:

providing an intermediate belt transfer module having a predetermined profile;

providing a collapsible frame providing a handle on said collapsible frame;

standing said collapsible frame in a vertical position;

attaching said collapsible frame to said intermediate belt transfer module;

hanging a belt onto said collapsible frame;

expanding said collapsible frame from a collapsed position to an expanded position by rotating said handle;

rotating said collapsible frame into said predetermined profile of said intermediate belt transfer module;

sliding said belt onto said intermediate belt transfer module; and removing said collapsible frame from said intermediate belt transfer module.

18. The method of claim 17, including retracting said collapsible frame to said collapsed position.

19. The method of claim 18 including storing said collapsible frame inside said intermediate belt transfer module.

* * * * *